US008616688B2

(12) United States Patent
Kimura et al.

(10) Patent No.: US 8,616,688 B2
(45) Date of Patent: Dec. 31, 2013

(54) LIQUID DISCHARGE HEAD AND ASSEMBLY METHOD OF LIQUID DISCHARGE HEAD

(75) Inventors: Satoshi Kimura, Kawasaki (JP); Satoshi Oikawa, Yokohama (JP); Kenji Kitabatake, Kawasaki (JP); Yukuo Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 249 days.

(21) Appl. No.: 13/112,902

(22) Filed: May 20, 2011

(65) Prior Publication Data

US 2011/0310161 A1 Dec. 22, 2011

(30) Foreign Application Priority Data

Jun. 21, 2010 (JP) ..... 2010-140915

(51) Int. Cl.
*B41J 2/175* (2006.01)

(52) U.S. Cl.
USPC ..... 347/87; 347/20; 347/86

(58) Field of Classification Search
USPC ..... 347/20, 86, 87
See application file for complete search history.

(56) References Cited

U.S. PATENT DOCUMENTS 6,305,785 B1 10/2001 Hosaka et al.

*Primary Examiner* — Matthew Luu
*Assistant Examiner* — Justin Seo
(74) *Attorney, Agent, or Firm* — Canon USA Inc IP Division

(57) ABSTRACT

An assembly method of a liquid discharge head is provided. The liquid discharge head includes an element substrate, an electrode portion, a flexible wiring member which has the element substrate at one end and the electrode portion at another end, and includes a plurality of bent portions, wherein, each edge line of at least two bent portions are not parallel and a housing. The assembly method includes a step for providing the flexible wiring member and the housing in which the element substrate is fixed on a first surface of the housing, a step for fixing the flexible wiring member on a second surface of the housing while holding the electrode portion at a position on a third surface of the housing where the electrode portion to be fixed, and a step for fixing the electrode portion to the position.

7 Claims, 8 Drawing Sheets

LIQUID DISCHARGE HEAD AND ASSEMBLY METHOD OF LIQUID DISCHARGE HEAD

BACKGROUND OF THE INVENTION

1. Field of the Invention

The present invention relates to a liquid discharge head and an assembly method of the liquid discharge head.

2. Description of the Related Art

Conventionally, in an ink jet head which is a representative one of the liquid discharge head, a configuration using a flexible wiring member (flexible cable) has been known. The flexible cable electrically connects a recoding element substrate generating energy for discharging liquid and an electrode portion performing an electric connection to an inkjet recoding apparatus. Since the flexible cable has flexibility, a position of the electrode portion can be set a desired position.

If the flexible cable has a configuration exposing itself outside the ink jet head, there is a possibility that the flexible cable touches the ink jet recording apparatus when the ink jet head is attached/detached, and a wiring in the flexible cable may be damaged.

U.S. Pat. No. 6,305,785 discusses a liquid discharge head having a configuration in which parts other than the parts of the flexible cable including the recording element substrate and the electrode portion are located at an inside of a tank holder and not exposed outside. An ink tank is detachable in the tank holder.

On the other hand, when an ink holder is integrally composed with an inkjet head, for providing the configuration that does not expose the flexible cable outside as described in U.S. Pat. No. 6,305,785, the flexible cable may be covered with another member. In such a case, issues, such as increase in a production step and cost increase may occur.

Thus, for providing a structure which can keep the flexible cable away from touching the ink jet recording apparatus at a time of attaching/detaching the ink jet head to the ink jet recording apparatus, a configuration in which the flexible cable exposed outside is fixed to a housing such as the ink tank or the ink holder, can be considered. Japanese Patent Application Laid-Open No. 2006-341385 discusses an ink jet head in which apart of a bent portion of the flexible cable is fixed to the housing. As illustrated in FIG. 9 in Japanese Patent Application Laid-Open No. 2006-341385, an adhesive is beforehand coated on a surface of the housing (the second surface 60), and the flexible cable is fixed to the housing in a step of bending the flexible cable. Therefore, in this step, an electrode portion (an electrical contact substrate H1005) is in a state not contacting to the housing.

The flexible cable provided in the ink jet head described in the above-described U.S. Pat. No. 6,305,785 has two bent portions (a bent portion 19 and a bent portion 20), and each edge line is not parallel.

In the ink jet head provided with the flexible cable including two edge lines not parallel, an issue generated when the electrode portion is fixed after fixing the flexible cable to the housing as described in Japanese Patent Application Laid-Open No. 2006-341385, will be described.

Since the flexible cable is designed having a margin of a length in a direction in which the flexible cable is bent, there is a possibility that an attachment of the electrode portion to the housing is shifted from an original position according to an attachment position of the flexible cable. In such a case, when the ink jet head is mounted in the ink jet recording apparatus, there is an issue concerning a reliability of electrical connection that the electrode portion of the ink jet head is not in contact with an electrode portion in the recording apparatus side. On the other hand, if the electrode portion of the ink jet head is fixed adjusting to the attachment position after the flexible cable is fixed to the housing, there is a case in which the electrode portion is set to the position by force. In such a case, since the two edge lines are not parallel, there is a possibility that wiring in the flexible cable is twisted.

SUMMARY OF THE INVENTION

The present invention is directed to a solution to an issue in a liquid discharge head provided with a flexible cable in which at least two edge lines are not parallel. More particularly, the present invention relates to an assembly method of a liquid discharge head which can fix an electrode portion to a housing with good positional accuracy and further, can reduce a possibility to fix a wiring in the flexible cable to the housing in a twisted state.

According to an aspect of the present invention, an assembly method of a liquid discharge head discharging liquid is provided wherein the liquid discharge head includes an element substrate provided with an energy generating element for generating energy to discharge liquid, an electrode portion configured to electrically connect the element substrate and an outside, a flexible wiring member which has the element substrate at one end and the electrode portion at another end, is configured to electrically connect the element substrate and the electrode portion, and further includes a plurality of bent portions which are bent, wherein, in the plurality of the bent portions, each edge line of at least two bent portions are not parallel in the flexible wiring member, and a housing including a first surface on which the element substrate is fixed, a second surface on which the flexible wiring member is fixed, and a third surface on which the electrode portion is fixed, and wherein the assembly method includes a step for providing the flexible wiring member provided with the element substrate and the electrode portion and the housing in which the element substrate is fixed on the first surface, a step for fixing the flexible wiring member on the second surface while holding the electrode portion at a position on the third surface where the electrode portion to be fixed, and a step for fixing the electrode portion to the position, wherein the step for providing, the step for fixing the flexible wiring member, and the step for fixing the electrode portion are performed in this order.

According to the present invention, the electrode portion can be fixed to the housing with high positional accuracy and further, the possibility that the wiring in the flexible cable is fixed to the housing while twisting can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An ink jet head which is representative as a liquid discharge head will be described using drawings as an exemplary embodiment of the present invention.

[Ink Jet Head]

Figure 1:
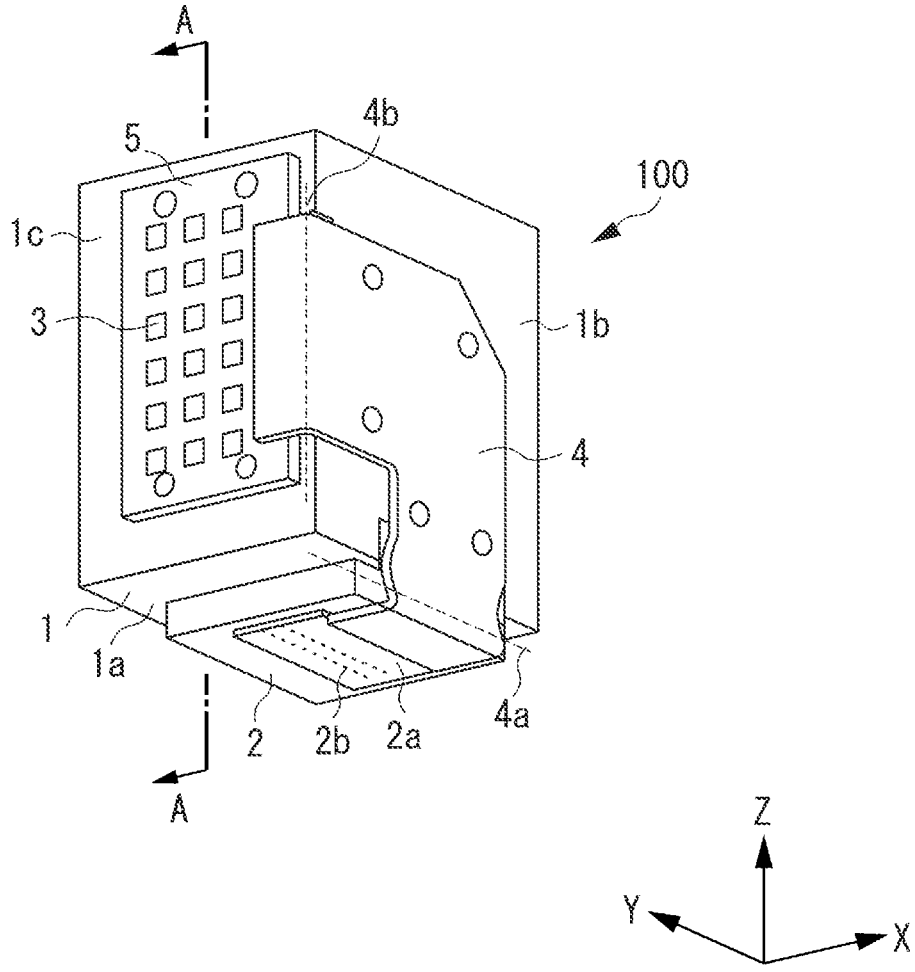
FIG. 1 is a perspective view schematically illustrating an ink jet head according to an exemplary embodiment applicable to the present invention.

FIG. 1 illustrates a schematic view of an ink jet head 100. The ink jet head 100 in the present exemplary embodiment includes an ink tank 1 which is a housing for storing ink, a recording element unit 2 in which a recording element substrate 2*a* is provided, a flexible cable 4 which is a flexible wiring member, and a contact substrate 5 which is an electrode portion. The recording element unit 2 is attached on a surface 1*a* (a first surface), the flexible cable 4 is attached on a surface 1*b* (a second surface), and the contact substrate 5 is attached on a surface 1*c* (a third surface) of the ink tank 1.

In the following descriptions, an X direction is a parallel direction to a short side part of the recording element substrate 2*a*, a Y direction is a parallel direction to a longitudinal part of the recording element substrate 2*a*, and a Z direction is a vertical direction to the surface 1*a* of the ink tank 1.

Figure 6A:
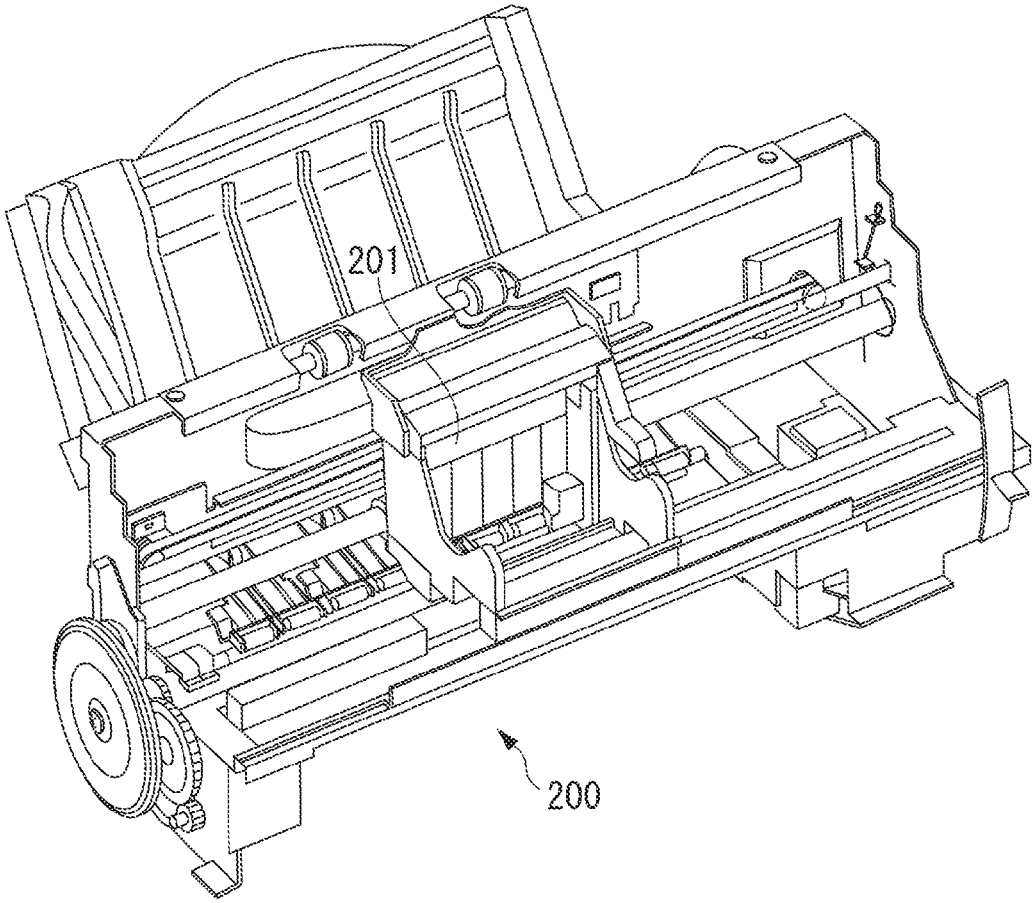
FIGS. 6A and 6B illustrate an ink jet recording apparatus in which the ink jet head is mounted.
Figure 6B:
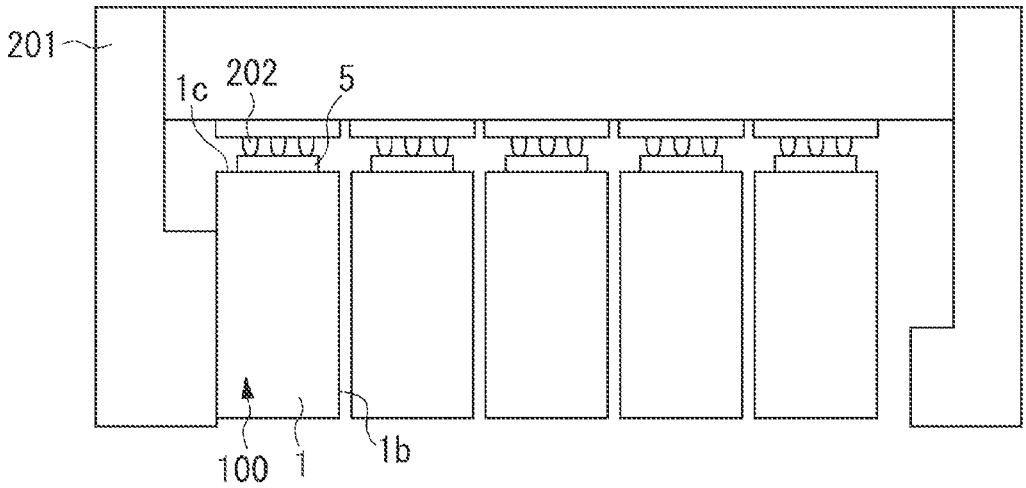

The recording element substrate 2*a* includes discharge ports 2*b* and energy generating elements (not illustrated), such as a heater, for generating energy for discharging ink from the discharge ports 2*b*. In the contact substrate 5, contact portions 3 are provided. The contact portions 3 electrically contact a recording apparatus 200, which is an outside of the ink jet head 100, to the ink jet head 100 by contacting to contact portions 202 on the recording apparatus side (FIG. 6B).

Figure 3A:
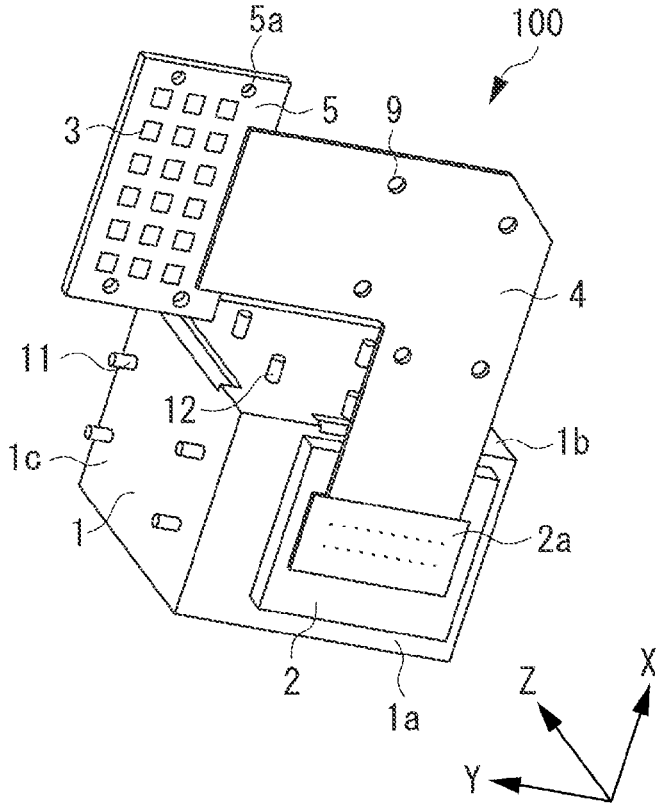
FIGS. 3A to 3D illustrate the assembly method of the ink jet head according to the exemplary embodiment applicable to the present invention.

The flexible cable 4 includes the recording element unit 2 attached to one end and the contact substrate 5 attached to an opposite end. The recording element substrate 2*a* and the contact substrate 5 are electrically connected by the flexible cable 4. As illustrated in FIG. 3A, the flexible cable 4 has an L shape. In the state fixed to the ink tank 1, the flexible cable 4 is bent at two points, and directions of edge lines 4*a* and 4*b*, which are bent lines at the bent portion (refer to FIG. 1), are crossed each other.

In a case that the number of wirings in the flexible cable 4 is many, if the wirings are drawn out from the short side part of the recording element substrate 2*a*, the size of the ink jet head 100 in the X direction becomes large. Further, if such ink jet heads 100 of a plurality of colors are arranged, a width of the ink jet recording apparatus 200 may increase. Therefore, as illustrated in FIG. 1, it is desirable that the wirings in the flexible cable 4 are connected in the longitudinal part of the recording element substrate 2*a*.

A power source and a signal are supplied from the ink jet recording apparatus 200 to an energy generating element via the contact portions 3 and the flexible cable 4, so that the energy generating element is driven. With this configuration, ink is discharged from the discharge port 2*b* and recording is performed on a recording medium such as paper.

In the present exemplary embodiment, although the contact portions 3 are provided on the contact substrate 5, the contact portions 3 can be located on the flexible cable 4 without providing the contact substrate 5. In such a case, a part in which the contact portion 3 is provided in the flexible cable 4 is made to be an electrode portion. As another configuration, the recording element unit 2, the flexible cable 4, and the contact substrate 5 can be attached to a tank holder in which the ink tank can be attached and detached.

[Ink Jet Recording Apparatus]

The ink jet recording apparatus 200 in which the ink jet head 100 is detachably attached will be described referring to FIGS. 6A and 6B. FIG. 6A is an outline perspective view of the ink jet recording apparatus 200. FIG. 6B is a schematic view of a state in which the ink jet head 100 is mounted in a carriage 201 provided in the inkjet apparatus 200, viewing from an upper plane.

When the ink jet heads 100 of a plurality of colors are arranged in a line in the ink jet apparatus 200, if the contact portions 3 are provided on the surface 1*b* of the ink tank 1, the contact portions 202 in the ink jet apparatus side are provided between adjacent ink jet heads 100. In such a case, the width of the recording apparatus 200 is enlarged by a space in which the contact portions 202 in the ink jet apparatus 200 side are provided.

Thus, as described above, in the present exemplary embodiment, the wiring of the L-shaped flexible cable 4 is connected in the longitudinal part of the recording element substrate 2*a*, and the flexible cable 4 is bent at two points, so that the contact parts 3 are provided on the surface 1*c* of the ink tank 1. With this structure, since there is not necessary to provide the contact portions 202 in the ink jet recording apparatus 200 side between the ink jet heads 100, the ink jet head 100 can be arranged close to each other.

[Assembly Method of the Ink Jet Head]

Figure 2:
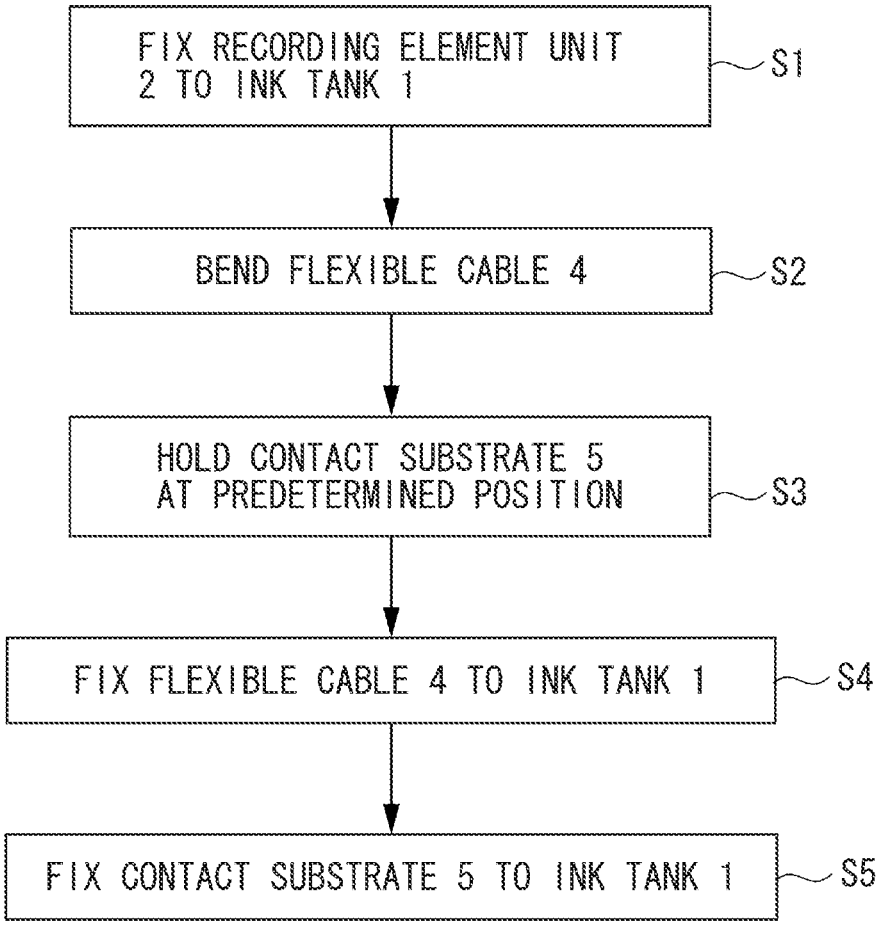
FIG. 2 is a flow chart illustrating an assembly method of the ink jet head according to the exemplary embodiment applicable to the present invention.

FIG. 2 and FIGS. 3A to 3D illustrate an assembly process of the ink jet head 100. FIG. 2 is a flowchart of the assembly process of the ink jet head 100. FIGS. 3A to 3D illustrate the steps corresponding to FIG. 2.

Quality of recording by the ink jet head 100 greatly depends on accuracy of an attachment position of the recording element unit 2 to the ink tank 1. Therefore, when the ink jet head is assembled, in step S1, an attachment position of the recording element unit 2 to the ink tank 1 is determined at first, and the recording element unit 2 is fixed on the surface 1*a* of the ink tank 1. (FIG. 3A) At this time, the flexible cable 4 can be connected to the recording element unit 2 beforehand, or can be connected to the recording element unit 2 after fixing the recording element unit 2 to the ink tank 1.

Then, in step S2, the flexible cable 4 is bent. In step S3, the contact substrate 5 is held at a holding position to the ink tank 1 in the directions of X and Z so that the contact portions 3 contact to the contact portions 202 (FIG. 6) of the ink jet recording apparatus 200. (FIG. 3B) At this time, pins 11 (protrusion portions) provided on the surface 1*c* of the ink tank 1 will be in a state in which the pins 11 fit into opening portions 5*a* provided in the contact substrate 5.

In the holding state, since the contact substrate 5 is not fixed to the ink tank 1 and the flexible cable 4 is designed to have a size to be flexible, the contact substrate 5 is movable in the Y direction. The holding method of the substrate 5 will be described below.

Although the flexible cable which has been bent beforehand can be used, it is more desirable to hold the contact substrate 5 while bending the flexible cable 4 when the easiness of handling is considered. Further, like the ink jet head 100 illustrated in FIG. 1, when the contact substrate 5 provided with the contact portions 3 is used, the connection of the contact substrate 5 and the flexible cable 4 is preferably performed before the holding step of the contact substrate 5 (step S3).

Figure 3B:
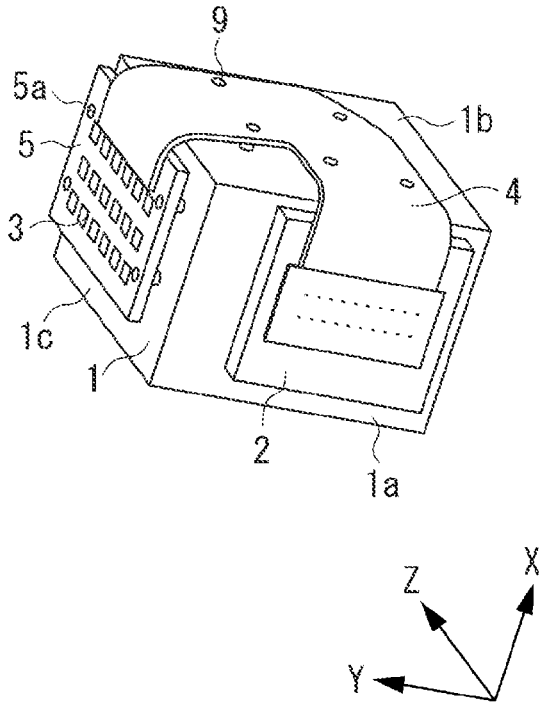
Figure 3C:
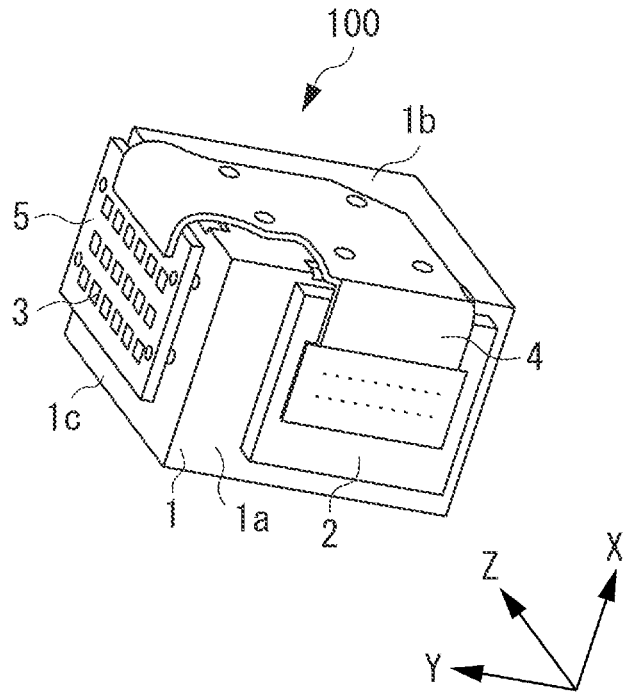

Then, while maintaining the state in FIG. 3B, openings 9 provided in the flexible cable 4 are fitted to pins 12 provided on the surface 1*b* of the ink tank 1. In step S4, the pins 12 are caulked by heat welding or ultrasonic welding, so that the flexible cable 4 can be fixed on the surface 1*b* of the ink tank 1. (FIG. 3C) At this time, since the end of the flexible cable 4, to which the contact substrate 5 is attached, has not been fixed to the ink tank 1, a flexure of the flexible cable 4 in the outside direction of the ink tank 1 can be controlled in a predetermined amount by adjusting the flexure of the flexible cable 4.

Figure 3D:
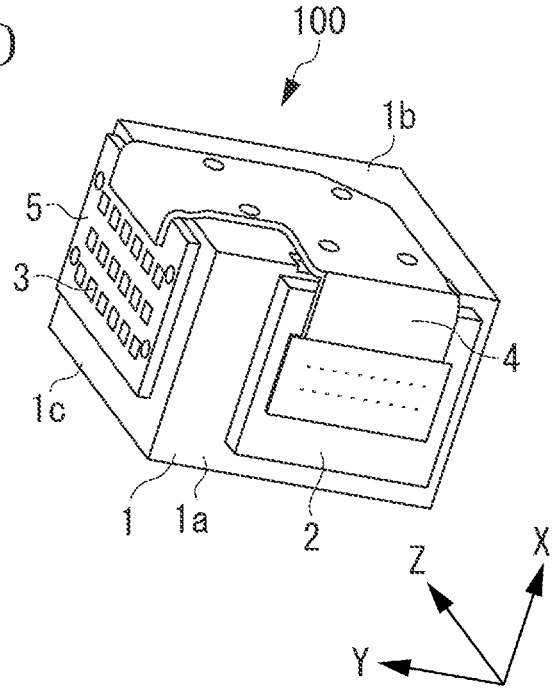

Finally, in step S5, the contact substrate 5 is fixed to the ink tank 1 by welding the pins 11 fitted into the opening portions 5*a* of the contact substrate 5 and then, the assembly of the ink jet head 100 is completed. (FIG. 3D)

As described above, since the flexible cable 4 is fixed to the ink tank 1 in a state that one end of the flexible cable 4 is not fixed to the ink tank 1, it is possible to control the flexure of the flexible cable 4. Accordingly, even when directions of the bent lines of the flexible cable 4 are crossed, the possibility can be reduced that the flexible cable 4 is twisted and fixed to the ink tank 1 while having a load in the inside wirings 20.

It is preferable to assemble the ink jet head 100 such that the flexure of the flexible cable 4 in the Y direction may occur near the bent portion in the contact portions 3 side and the flexure in the Z direction may occur near the bent portion in the recording element unit 2 side. Further, it is preferable to assemble the ink jet head 100 so as to have the flexure of the flexible cable 4 in the direction of the ink tank 1, i.e., toward an inside of the ink jet head 100. With this flexure, the possibility can be reduced that the flexure part of the flexible cable 4 contacts with an inside of the apparatus when the ink jet head 100 is attached or detached to the ink jet recording apparatus 200.

Further, when the contact substrate 5 is fixed to the ink tank 1 after fixing the flexible cable 4 to the ink tank 1, the attachment position of the contact portion 3 is shifted, so that the reliability of the electrical connection with the ink jet recording apparatus 200 may be lowered.

Thus, as described in the present exemplary embodiment, the flexible cable 4 is fixed to the ink tank 1 in a state that the contact substrate 5 is held at the attachment position to the ink tank 1. Therefore, attachment positional accuracy to the ink tank 1 of the contact portion 3 in the X direction and the Z direction can be maintained, so that the possibility to lower the reliability of an electrical connection with the ink jet recording apparatus 200 can be controlled.

In the present exemplary embodiment, before the process for holding the contact substrate 5, it is desired to provide the process for providing the flexible cable 4 including the recording element unit 2 at one end and the contact substrate 5 at another end thereof, and the ink tank 1 to which the recording element unit 2 is fixed.

In the present exemplary embodiment, a part of the flexible cable 4, in which the recording element unit 2 and the contact substrate 5 are not connected, is fixed on the surface 1*b* of the ink tank 1. However, the part can be fixed to a plurality of surfaces of the ink tank.

In the present exemplary embodiment, it is described that the edge lines 4*a* and 4*b* are crossed each other. However, when the edge lines 4*a* and 4*b* are skew lines, the wirings in the flexible cable 4 may be twisted. In other words, the present exemplary embodiment is effective in cases in which the edge lines at the bent portion are not parallel.

Further, in the present exemplary embodiment, the flexible cable 4 and the contact substrate 5 are fixed to the ink tank 1 by welding the pins fitted into the openings. However, the fixing method is not limited to the welding and an adhesive can be used for fixing.

Next, a method for holding the contact substrate 5 provided with the contact portions at a predetermined position of the ink tank 1 and a mechanism thereof will be described referring to FIGS. 4A and 4B.

Figure 4A:
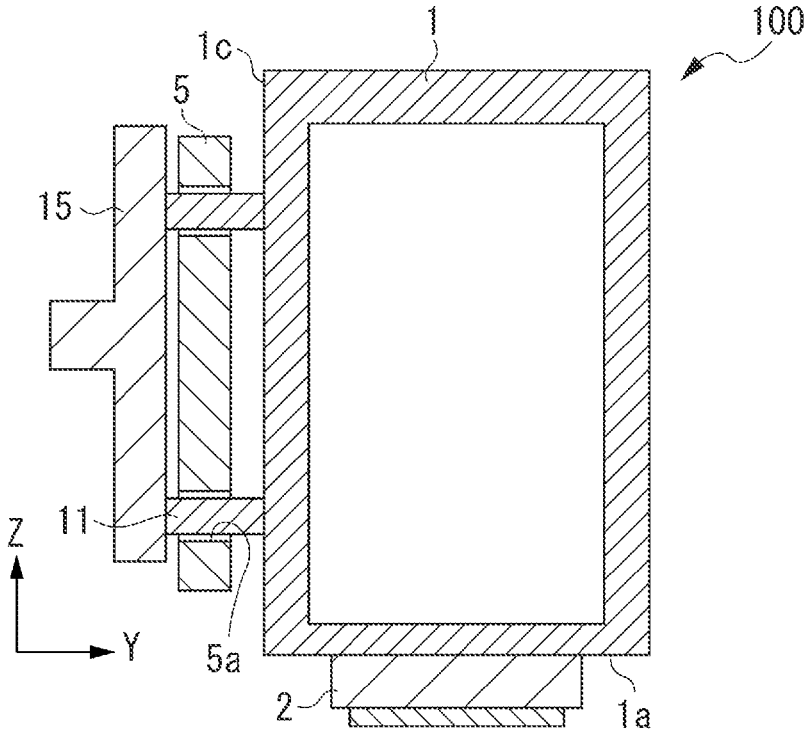
FIGS. 4A and 4B schematically illustrate a holding state of a contact substrate.

FIG. 4A illustrates a cross-sectional view at an A-A line in FIG. 1 when the contact substrate 5 is held by a jig 15. In a method illustrated in FIG. 4A, the pins 11 provided on the surface 1*c* of the ink tank 1, on which the contact substrate 5 is fixed, are fitted into the opening portions 5*a* provided in the contact substrate 5, so that the contact portions 3 become to a state fitted to the attachment position to the ink tank 1 in the X direction and the Z direction.

In this state, by pressing the top ends of the pins 11 with the jig 15, the contact substrate 5 can be held at the attachment position of the contact portions 3 to the ink tank 1 in the X direction and the Z direction. Since the flexible cable 4 is designed to have a size to be flexed, in the holding step of the contact substrate 5 (step S3), the contact substrate 5 is movable in the Y direction.

Figure 4B:
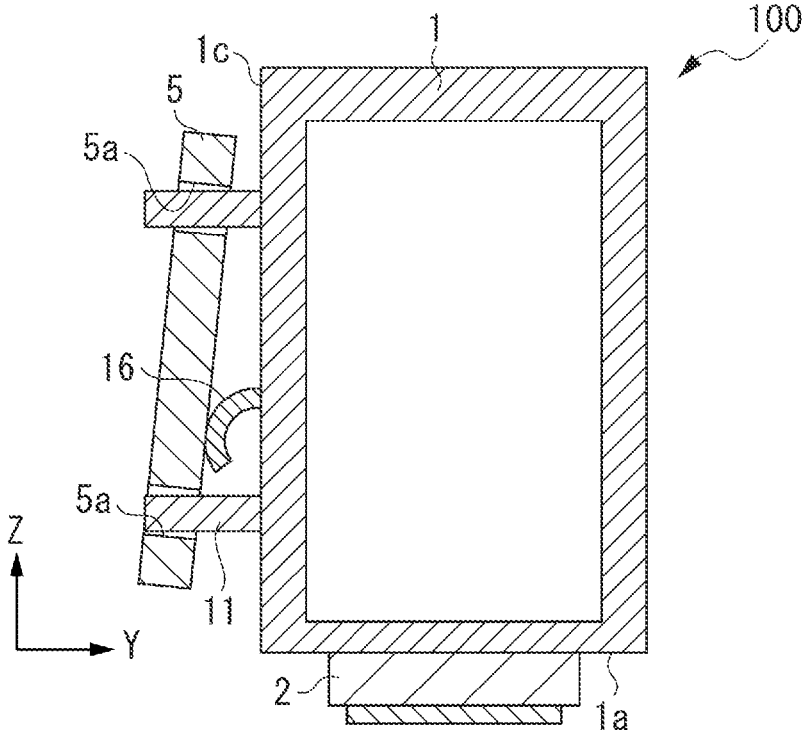

FIG. 4B illustrates a modified example of the above-described holding method in FIG. 4A. In the ink jet head 100 in the modified example, a hole diameter of the opening portions 5*a* provided in the contact substrate 5 is set to be larger than a diameter of the pins 11 protruding from the ink tank 1 by a size within a range in which the attachment positional accuracy of the contact portions 3 to the ink tank 1 can be permitted. By fitting the pins 11 into the opening portions 5*a*, the contact portions 3 will be in a state that the contact portions 3 are fitted to the attachment position to the ink tank 1 in the X direction and the Z direction. At this time, since the diameter of the opening portions 5*a* provided in the contact substrate 5 is larger than the diameter of the pins 11, the contact substrate 5 is movable in the X direction and the Z direction within the range in which the attachment positional accuracy of the contact portions 3 to the ink tank 1 can be permitted.

On the surface 1*c* of the ink tank 1 on which the contact substrate 5 is fixed, an elastic member 16 for pushing the contact substrate 5 from the ink tank 1 toward the outside direction is provided. Since elastic force of the elastic member 16 acts thereon, the contact substrate 5 inclines to the surface 1*c* of the ink tank 1, and the opening portions 5*a* in the contact substrate 5 are hooked on the pins 11 (FIG. 4B). Accordingly, the contact substrate 5 can be held at the attachment position of the contact portions 3 to the ink tank 1 in the X direction and the Z direction. In the holding step of the contact substrate 5 (step S3), since the flexible cable 4 is designed with a size to be flexed, the contact substrate 5 is movable in the Y direction to push back the elastic member 16.

In the configuration illustrated in FIG. 4B, the elastic member 16 is provided on the ink tank 1 so as to incline the contact substrate 5 in the Z direction to the surface 1*c* of the ink tank 1. However, the elastic member 16 can be provided so as to incline the contact substrate 5 in the X direction, i.e., to the sheet surface in FIG. 3B. When the contact substrate 5 is held in a state inclining in the X direction, twisting of the flexible cable 4 can be controlled in the holding state, so that it is more desirable. The elastic member 16 may be a spring or a member which can also function as an electrode for detecting existence of ink in the ink tank 1.

Figure 5A:
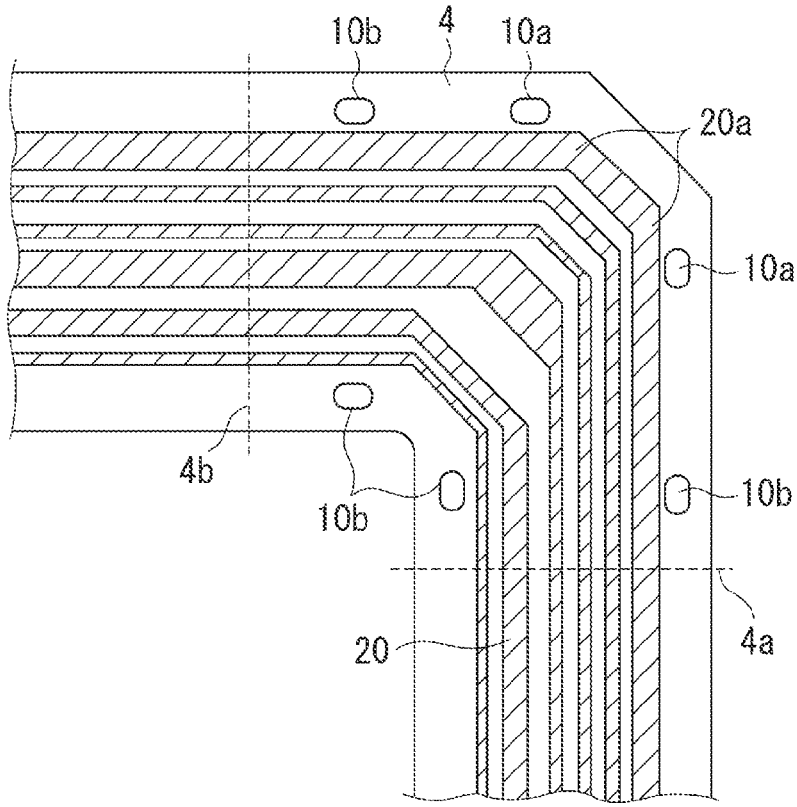
FIGS. 5A and 5B schematically illustrate a flexible cable.
Figure 5B:
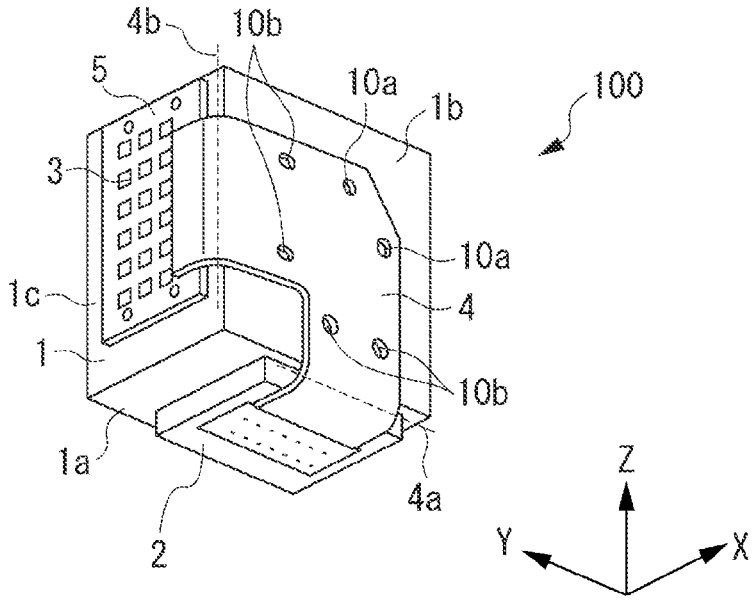

FIG. 5A illustrates inner wirings 20, permeating a part of a surface film layer of the flexible cable 4. FIG. 5B is a perspective view illustrating the ink jet head 100 using the flexible cable 4 illustrated FIG. 5A. The pins 12 (in FIG. 3A) protruding from the surface 1*b* of the ink tank 1, to which the flexible cable 4 is fixed, are fitted into the openings 10 in the flexible cable 4, welded by heat welding, and caulking, so that the flexible cable 4 is fixed to the tank 1.

As illustrated in FIG. 5A, the openings 10 (10*a* and 10*b*) for fixing the flexible cable 4 have elongate holes extending in an extending direction of the wirings 20 (a wiring direction) provided near the openings 10. On the other hand, diameters of the openings 10 in a vertical direction to the wiring direction have a size equal to or a slightly larger than the diameter of the pins 12 protruding from the ink tank 1.

Accordingly, when the flexible cable 4 is fixed to the ink tank 1, the flexible cable 4 can move in the wiring direction but is restricted to moving in the vertical direction to the wiring direction. Therefore, when the flexible cable 4 is fixed to the ink tank 1, occurrence of the flexure in the vertical direction to the wiring direction can be suppressed and the flexible cable 4 can be fixed while being flexed in the wiring direction. Accordingly, the possibility can be further reduced that the flexible cable 4 is fixed to the ink tank 1 while being twisted.

At the bent portion of the flexible cable 4 which is bent at the edge lines 4*a* and 4*b*, since the wirings 20 in the flexible cable 4 are provided so as to be expanded in one direction, there is little chance that the wirings 20 is twisted even if the flexure generates at the bent portion. On the other hand, the wirings 20 are bent in a plane of the flexible cable 4 at a part far from the bent portion. Thus, when the flexure generates at a two-dimensionally-bent portion 20*a* of the wirings 20, the flexible cable may be flexed in a different direction from the wiring direction, and there is a possibility that the wirings 20 may be twisted.

Therefore, when the flexible cable 4 is fixed on the surface 1*b* of the ink tank 1, it is desirable that a portion near the two-dimensionally-bent portion 20*a* in the plane of the flexible cable 4 is fixed at first, and then the portion near the bent portion (4*a* or 4*b*) of the flexible cable 4 is fixed. In other word, in FIG. 5A, it is desirable to fix the opening 10*a* at first and then, to fix the opening 10*b*.

Further, as a position where the opening 10*a* to be provided, if the openings 10 are provided near the two-dimensionally-bent portion 20*a* of the wirings 20, the flexure of the flexible cable 4 at the two-dimensionally-bent portion 20*a* can be suppressed, so that it is more preferable.

If the two-dimensionally-bent portion 20*a* of the wirings 20 is bent at a right angle, the flexible cable 4 may be flexed in the vertical direction to wiring direction. In such a case, the possibility that the wirings 20 are twisted becomes higher. Therefore, as illustrated in FIG. 5A, it is desirable to use the flexible cable 4 in which wirings 20 are arranged so as not to be bent at a right angle.

Comparative Example

If the flexible cable 4 is fixed to the housing after fixing the contact substrate 5 to the ink tank 1, the flexible cable 4 is fixed in a state that the both ends of the flexible cable 4 are fixed. Thus, that flexure of the flexible cable 4 may increase. If the flexure to the outside direction of the ink tank 1 is large, a possibility that the flexure part contacts with an inside of the recording apparatus 200 becomes higher, when the ink jet head 100 is attached and detached. Further, if the controlling the flexure is difficult, the wirings 20 in the flexible cable 4 may be twisted depending on the direction of flexure, and there is a possibility that the flexible cable 4 is fixed to the housing with a load remaining on the wirings 20.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-140915 filed Jun. 21, 2010, which is hereby incorporated by reference herein in its entirety.

What is claimed is:

1. An assembly method of a liquid discharge head for discharging liquid: wherein the liquid discharge head includes:

an element substrate provided with an energy generating element for generating energy to discharge liquid;

an electrode portion configured to electrically connect the element substrate and an outside;

a flexible wiring member which has the element substrate at one end and the electrode portion at another end, is configured to electrically connect the element substrate and the electrode portion, and further includes a plurality of bent portions which are bent, wherein, in the plurality of the bent portions, each edge line of at least two bent portions are not parallel; and a housing including a first surface on which the element substrate is fixed, a second surface on which the flexible wiring member is fixed, and a third surface on which the electrode portion is fixed, and the assembly method comprises:

a step for providing the flexible wiring member provided with the element substrate and the electrode portion and the housing in which the element substrate is fixed on the first surface;

a step for fixing the flexible wiring member on the second surface while holding the electrode portion at a position on the third surface where the electrode portion is to be fixed; and a step for fixing the electrode portion to the position, wherein the step for providing, the step for fixing the flexible wiring member, and the step for fixing the electrode portion are performed in this order.

2. The assembly method of the liquid discharge head according to claim 1, wherein if the electrode portion is held at the position, the electrode portion can move in a direction crossing to the third surface.

3. The assembly method of the liquid discharge head according to claim 1, wherein the electrode portion includes an opening, the housing includes a protrusion portion which protrudes with respect to the third surface and is fitted into the opening, and an elastic member which contacts to the electrode portion and makes an elastic force thereof act in a direction crossing to the third surface, and the electrode portion is held at the position by hooking the protrusion portion to the opening by the elastic force of the elastic member.

4. The assembly method of the liquid discharge head according to claim 1, wherein the electrode portion includes an opening, the housing includes a protrusion portion which protrudes with respect to the third surface and is fitted into the opening, and the electrode portion is held at the position by pressing the protrusion portion with a pressing member in a state that the protrusion portion is fitted into the opening.

5. The assembly method of the liquid discharge head according to claim 1, wherein, in the step for fixing the flexible wiring member, the flexible wiring member is fixed to the second surface in order from a first position to a second position, wherein the first position is further from the edge lines than the second position.

6. The assembly method of the liquid discharge head according to claim 1, wherein the flexible wiring member includes a wiring for electrically connecting the element substrate and the electrode portion and a two-dimensionally-bent portion in which the wiring is bent in a plane of the flexible wiring member, and in the step for fixing the flexible wiring member, the flexible wiring is fixed in order from a first position to a second position further from the two-dimensionally-bent portion than the first position.

7. A liquid discharge head assembled by an assembly method of the liquid discharge head according to claim 1, wherein the flexible wiring member includes a wiring for electrically connecting the element substrate and the electrode portion and an elongate opening, the elongate opening being provided along the wiring and elongate in an extending direction, of the wiring the housing includes a protrusion portion which protrudes with respect to the second surface and is fitted into the elongate opening, and the flexible wiring member is fixed to the housing by welding the protrusion portion fitted into the elongate opening.

* * * * *